US006094171A

United States Patent [19]

Riddle et al.

[11] Patent Number: 6,094,171

[45] Date of Patent: Jul. 25, 2000

[54] EXTERNAL POD WITH AN INTEGRATED ANTENNA SYSTEM THAT EXCITES AIRCRAFT STRUCTURE, AND A RELATED METHOD FOR ITS USE

[75] Inventors: Robert G. Riddle, San Diego; Haigan K. Chea, Oceanside, both of Calif.

[73] Assignee: TRW Inc., Redondo Beach, Calif.

[21] Appl. No.: 09/178,355

[22] Filed: Oct. 23, 1998

[51] Int. Cl.[7] ..... H01Q 1/28

[52] U.S. Cl. ..... 343/708; 343/767

[58] Field of Search ..... 343/705, 708, 343/872, 767; H01Q 1/28

[56] References Cited

U.S. PATENT DOCUMENTS 3,026,516 3/1962 Davis ..... 343/705

*Primary Examiner*—Michael C. Wimer

*Attorney, Agent, or Firm*—Michael S. Yatsko

[57] ABSTRACT

An aircraft antenna system integrated into one or more walls of an equipment pod (12) mounted beneath an aircraft (10). The equipment pod (12) has at least one wall with an antenna notch built into it. The antenna notch is tapered or flared toward a wider opening and is bounded on each side by conductive portions of the same pod wall. Other walls of the pod (12) are made from conductive materials, which are in electrical contact with the aircraft structure. The equipment pod (12) provide multiple antenna structures for use in a variety of aircraft applications. Further, use of multiple pods (12) allows an aircraft to be more easily reconfigured for different missions by removing and replacing the equipment pod.

3 Claims, 9 Drawing Sheets

EXTERNAL POD WITH AN INTEGRATED ANTENNA SYSTEM THAT EXCITES AIRCRAFT STRUCTURE, AND A RELATED METHOD FOR ITS USE

BACKGROUND OF THE INVENTION

This invention relates generally to aircraft antenna systems and, more particularly, to aircraft antenna systems that conform to the surface of the aircraft and electromagnetically excites at least adjacent portions of the aircraft structure. U.S. patent application Ser. No. 08/712,686, filed Sep. 12, 1996 and entitled "Multifunction Structurally Integrated VHF-UHF Aircraft Antenna System," now U.S. Pat. No. 5,825,332, discloses an aircraft antenna system structurally integrated into an aircraft tail fin. Basically, a notch antenna is incorporated into an endcap structure of the vertically oriented tail fin assembly and excites a vertically-polarized electric field.

There are some specific applications of airborne electronics systems in which specialized electronics equipment is housed in an external pod attached to an aircraft. For example, synthetic aperture radar (SAR) equipment is typically housed in a pod mounted beneath an aircraft. The pod provides a protective, yet radio-frequency-transparent, housing for the SAR equipment, which performs radar scanning of the topology beneath the aircraft. Moreover, housing such equipment in a removable pod facilitates maintenance of the equipment and allows it to be moved from one aircraft to another with less difficulty.

A requirement of some of these applications is that there must be a capability to handle multiple broadcast and reception of radio-frequency (RF) signals sharing the same frequency band with a minimum of system degradation. This necessarily entails the separation of transmit and receive functions as much as possible. There are various techniques for meeting this requirement, such as phase cancellation, frequency separation, and spatial separation of separate transmit and receive antennas. One of the objects of the present invention is to provide separate transmit and receive antennas on aircraft, especially aircraft that have external equipment pods.

Although the prior patent application referred to discloses an antenna system that provides good performance for very-high-frequency (VHF) and ultra-high-frequency (UHF) radio signals, there is still a need for an antenna system that produces both vertically polarized and horizontally polarized fields, and that satisfies the requirements discussed above.

U.S. Pat. No. 5,184,141 to Connolly et al. suggests integration of an antenna into a load-bearing member of an aircraft structure. However, the antenna in Connolly et al. is a dipole or other type of antenna installed behind a transparent window in the aircraft surface, and does not directly excite any portion of the aircraft structure.

Accordingly, there is still a need for a multifunction antenna system for installation in manned or unmanned aircraft, to satisfy the requirement for spatially separated transmit and receive antennas. The antenna system should provide omnidirectional patterns of both vertically polarized and horizontally polarized radiation and should have low cost and weight penalties. The present invention meets all these requirements and has additional advantages over the prior art.

SUMMARY OF THE INVENTION

The present invention resides in an aircraft antenna system structurally integrated into an external equipment pod carried by an aircraft. Briefly, and in general terms, the antenna system comprises an externally mounted aircraft equipment pod, at least one wall of which includes an antenna notch formed from non-conductive material and positioned between two adjacent conductive regions of the pod wall. The notch and the two adjacent conductive regions are structurally integrated to perform mechanical functions of the equipment pod wall and the notch extends from a narrow region to a flared wider region. The antenna system further comprises an antenna feed terminating at a feed point located in the narrow region of the notch, to couple transmitted energy into the notch and to couple received energy out of the notch. The pod is mechanically connected to the aircraft by an electrically conductive connection, so that not only the adjacent conductive regions of the pod, but also other conductive regions of the entire aircraft structure, function as radiating or receiving components of the antenna system. The antenna system provides an omnidirectional radiation pattern supporting vertically and horizontally polarized communication functions for a variety of frequency bands.

In the illustrative embodiment of the invention, the external equipment pod includes at least two walls with antenna notches of non-conductive material. Each wall of the external equipment pod having an antenna notch also includes an antenna matching unit mounted adjacent to a narrow portion of the notch, to match the antenna impedance characteristics to transceiver equipment.

In accordance with a related method for configuring an aircraft for a specific mission, the invention comprises the steps of providing a plurality of external aircraft equipment pods, each having a different antenna configuration integrated into selected walls of the pod, and each capable of carrying specialized equipment enclosed within the pod walls; selecting an external equipment pod for a given mission, based in part on the antenna configuration needed for the mission; loading the pod, if necessary, with specialized equipment needed for the mission; and mounting the pod on an aircraft, using electrically conductive coupling devices. The antenna configuration of the selected and installed pod provides radiation patterns that are omnidirectional and exhibit high gain over a wide band of frequencies including VHF and UHF bands.

More specifically, the step of providing a plurality of external aircraft equipment modules includes providing an equipment pod wall that includes a notch of non-conductive material located between two conductive regions of the pod wall; and integrating into the equipment pod wall an antenna matching unit, for matching antenna characteristics with those of a transmitter or receiver.

It will be appreciated from this summary that the present invention represents a significant advance in the field of aircraft antenna design. Specifically, the invention provides a plurality of efficient multifunction antennas with instantaneous bandwidths wide enough to cover VHF and UHF communications, navigation and identification (CNI) bands and having desirably high gain performance in all directions. Moreover, the use of a removable equipment pod as multiple radiating antennas facilitates reconfiguration of aircraft for different missions. Other aspects and advantages of the invention will become apparent from the following more detailed description, taken in conjunction with the accompanying drawings.

DESCRIPTION OF THE PREFERRED EMBODIMENTS

Figure 1:
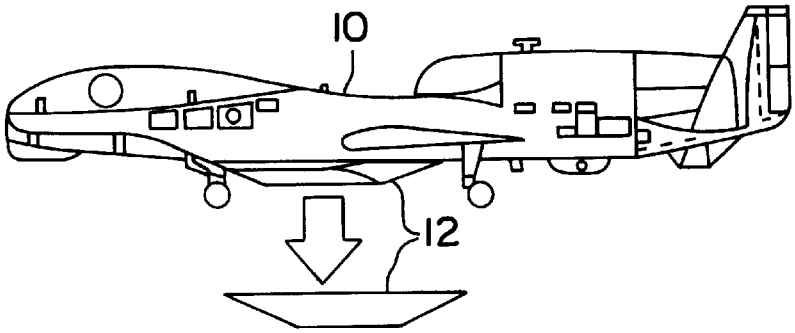
FIG. 1 is a simplified elevational view of an unmanned aircraft having an external equipment pod mounted beneath it.

As shown in the drawings for purposes of illustration, the present invention pertains to an aircraft antenna system that is integrated into an external equipment pod used for other purposes on an aircraft, and excites substantial portions of the entire aircraft structure at very-high frequencies (VHF) and ultra-high frequencies (UHF). There is a need for efficient, multifunction antennas that have instantaneous bandwidths that are wide enough to cover VHF and UHF transmission and reception functions. Ideally, these antennas should be conformal, low cost and light weight, to minimize their effect on aerodynamics of the aircraft and on its payload.

Prior to the present invention, external equipment pods were considered to be dedicated to a particular function other than radio-frequency (RF) communication, which is typically handled using standard 13-inch (33 cm) or 9-inch (23 cm) blade antennas. Blade antennas increase aerodynamic drag by approximately one percent and, because they protrude from the aircraft, are prone to damage. Proposals for conformal antennas have been limited to antenna elements installed behind electromagnetically transparent windows in the aircraft skin, or to the addition of smaller conformal antennas on a vertical tail fin endcap.

In accordance with the present invention, an externally mounted equipment pod is utilized to increase the number of antennas at VHF and UHF frequencies that can be installed on an aircraft. Basically, the external equipment pod itself is used to form multiple antennas with omnidirectional radiation patterns and without significant weight or aerodynamic drag penalty.

FIG. 1 depicts a known aircraft configuration in which an aircraft 10 carries an equipment pod 12 mounted beneath the fuselage of the aircraft. The pod 12 houses equipment for some mission-related purpose other than RF communication, such as synthetic aperture radar (SAR) equipment. Typically, the pod 12 is aerodynamically engineered to have a minimal effect on drag on the aircraft. In accordance with the invention, the pod 12 retains its original shape and dimensions but is constructed to include one or more antennas in its walls, as will be described in more detail below. In essence, each antenna integrated into the pod 12 is defined by a non-conductive notch between adjacent conductive portions of the walls of the pod. Further, the pod 12 is mechanically connected to the aircraft 10 through an electrically conductive attachment. When an antenna integrated into the pod is excited by an RF signal, substantial portions of the entire aircraft structure are also excited and, to some degree, the entire aircraft becomes part of the radiating antenna.

Figure 2:
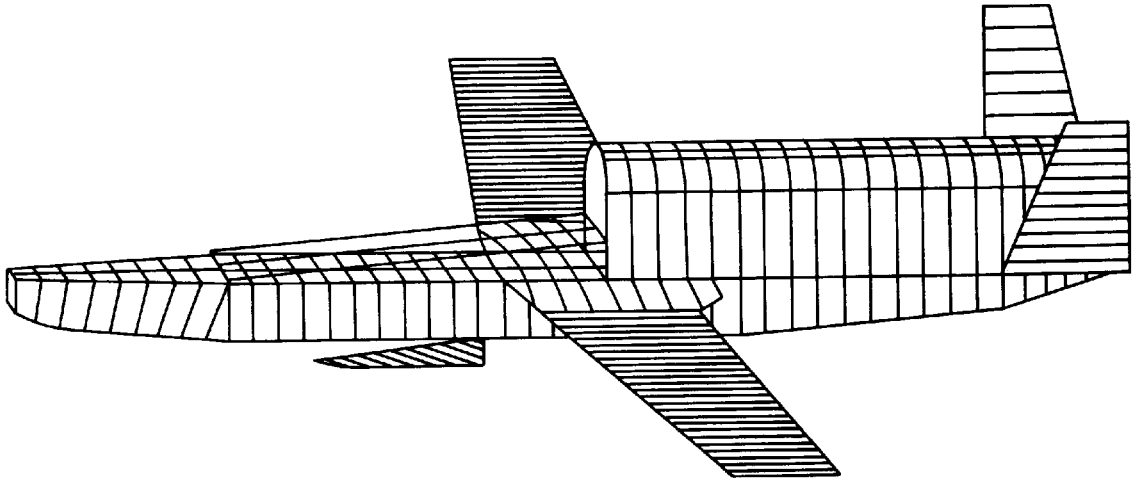
FIG. 2 is a wire model simulation of the aircraft and equipment pod shown in FIG. 1.

FIG. 2 depicts a wire grid model of the entire aircraft 10 and the attached pod 12. Using a well known numerical modeling technique referred to as the method of moments, the wire grid model provides computer-generated theoretical feed points, impedances and a radiation pattern for comparison with experimental measurements. From this model, the simulated antenna patterns of FIGS. 3–5 were obtained.

Figure 3:
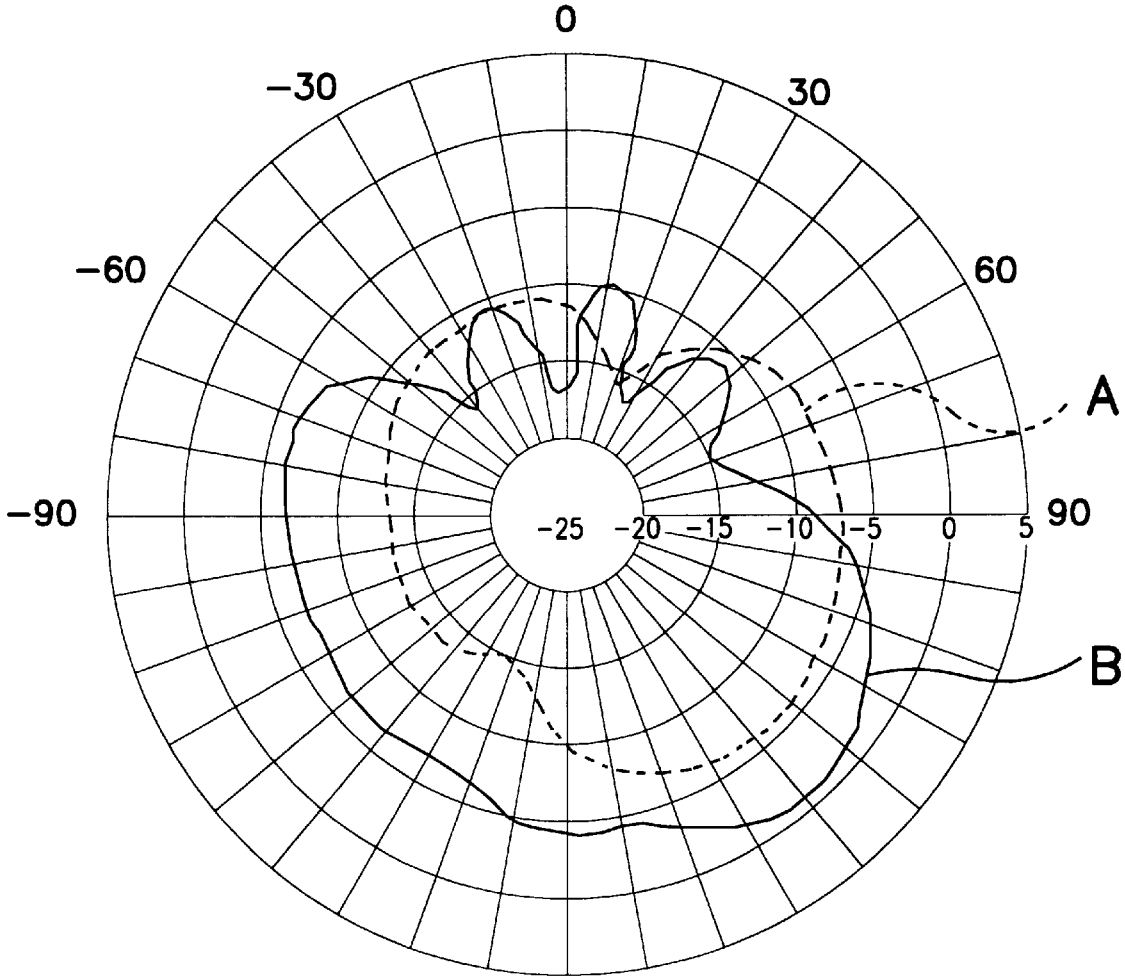
FIG. 3 is a simulated pitch cut antenna pattern using the wire model of FIG. 2, for a frequency of 40 MHz and showing horizontal polarization gain and vertical polarization gain plotted against the elevation angle in degrees.
Figure 4:
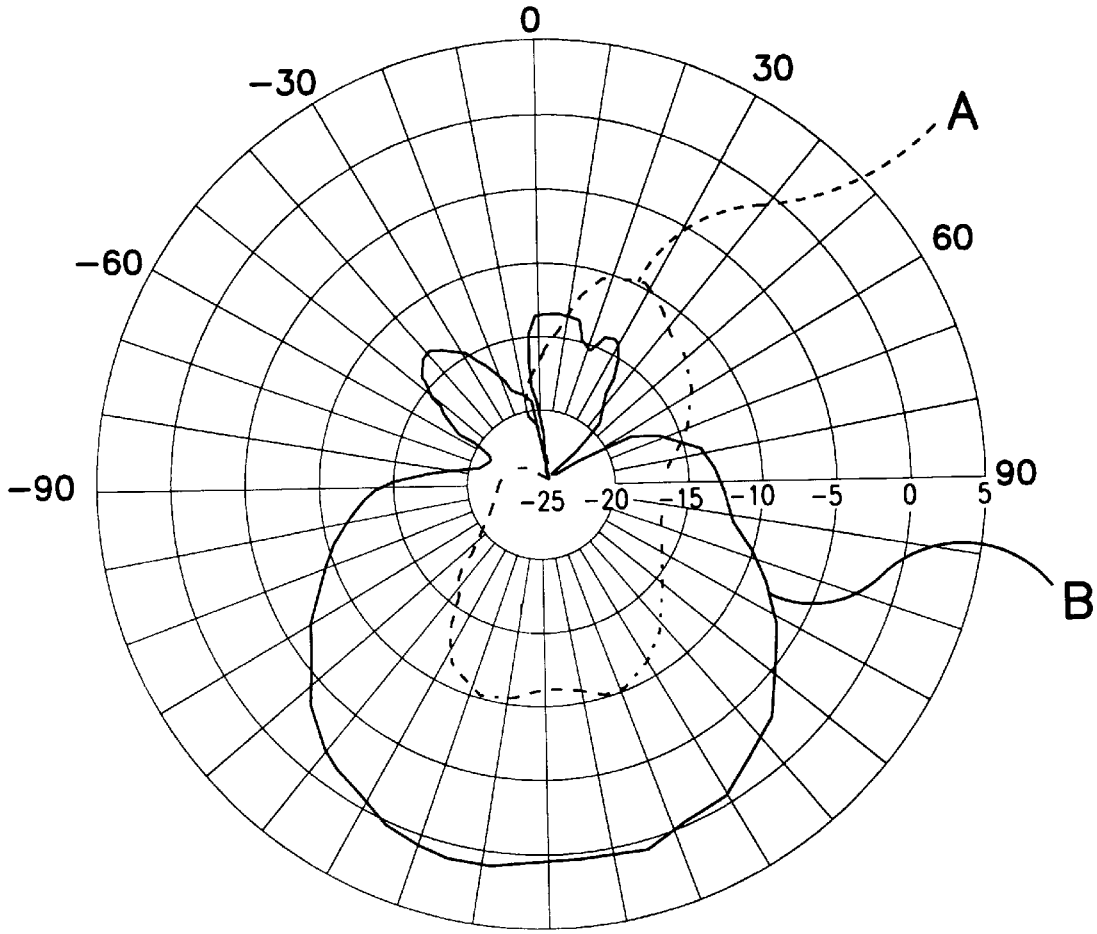
FIG. 4 is a simulated pitch cut antenna pattern similar to FIG. 3 but for a frequency of 60 MHz.
Figure 5:
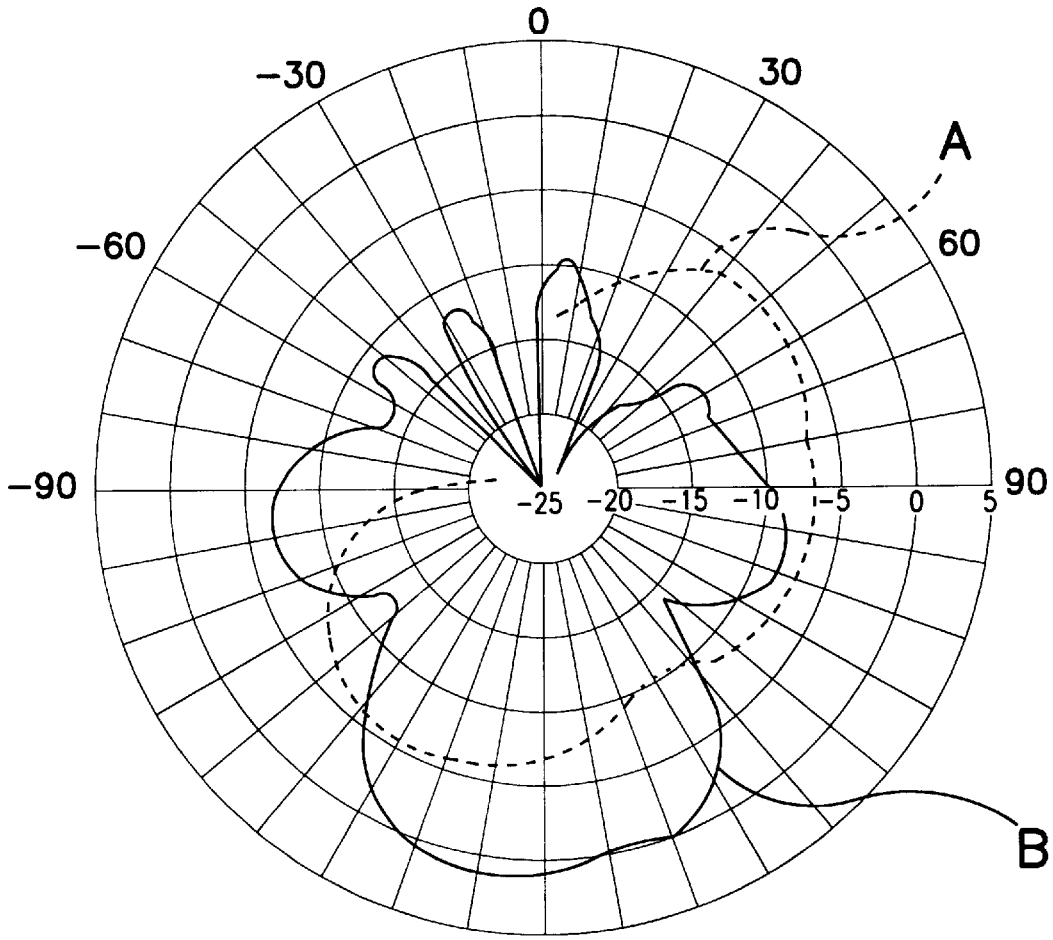
FIG. 5 is a simulated pitch cut antenna pattern similar to FIG. 3 but for a frequency of 80 MHz.

FIG. 3 shows the simulated pitch cut antenna pattern, i.e. the variation of gain for a 40 MHz (megahertz) signal, versus elevation angle measured in a plane perpendicular to the pitch axis of the aircraft. The 0° angle represents the direction toward the top of the aircraft and the +90° angle is the direction toward the nose of the aircraft. Curve A represents the horizontal polarization gain, and curve B the vertical polarization gain. FIGS. 4 and 5 are similar simulated antenna patterns, but for frequencies of 60 MHz and 80 MHz, respectively.

Figure 6:
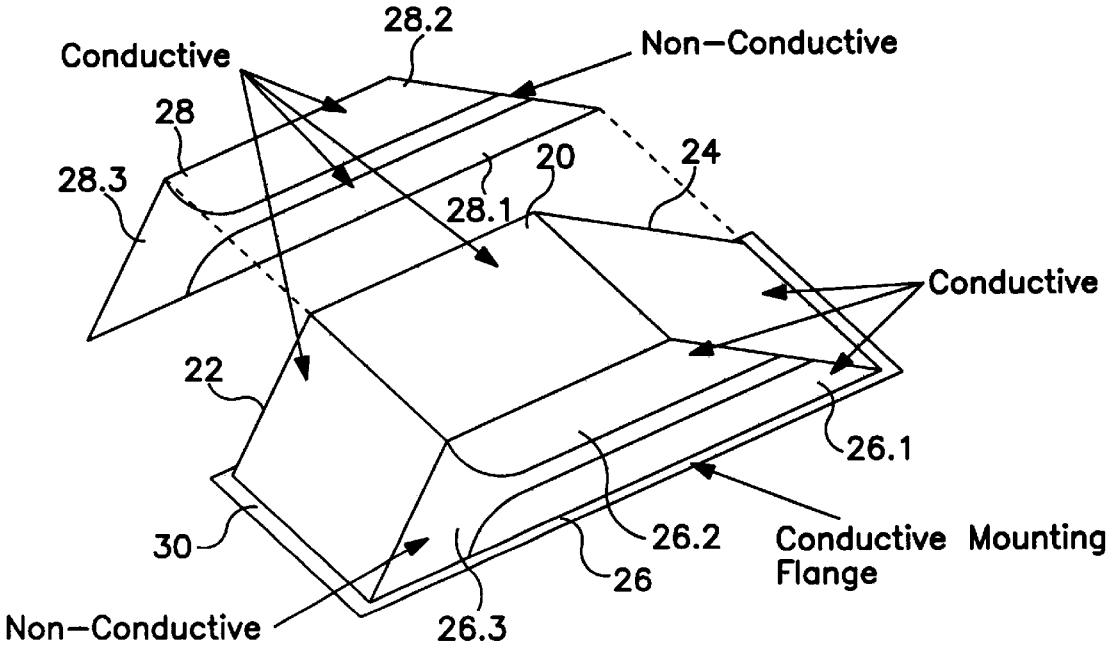
FIG. 6 is an exploded bottom perspective view of an external equipment pod used in the aircraft shown in FIG. 1.

FIG. 6 shows the equipment pod 12 in more detail. The pod 12 has a generally rectangular bottom 20, shown uppermost in the figure, and four sloping, generally rectangular panels, including forward and aft panels 22 and 24, and two side panels 26 and 28. In this embodiment, each of the side panels 26 and 28 is formed to include two conductive portions 26.1 and 26.2 or 28.1 and 28.2, and an intermediate non-conductive slot 26.3 or 28.3. The slot has a narrow section beginning at the transition to the forward panel 24, and extends in a generally horizontal direction toward the aft panel 22, flaring to a wider cross section at the transition to the aft panel. The bottom 20 and the forward and aft panels 22 and 24 are made entirely of conductive materials. The pod 12 also includes an integral flange 30 of conductive material, extending around the entire periphery of the top of the pod, for attachment to the aircraft 10.

The conductive materials in the pod 12 are chosen to provide both electrical conductivity and structural integrity. For example, carbon fiber/epoxy resin materials may be used for this purpose. The non-conductive materials in the slots 26.3 and 28.3 must also preserve the overall structural integrity of the pod 12. These materials may be, for example, phenolic honeycomb structures and glass/epoxy resin.

Figure 7:
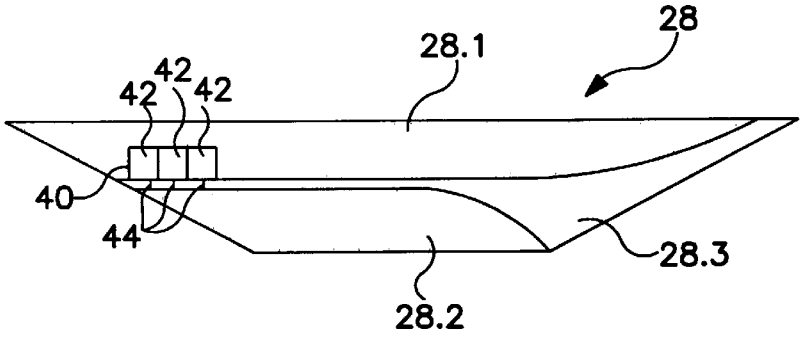
FIG. 7 is a more detailed view of one panel of the pod of FIG. 6, showing an antenna matching unit.

FIG. 7 shows the side panel 28 in elevation, with a integral antenna matching unit 40 located adjacent to the narrow end of the slot 28.3. The matching unit 40 is depicted as including three separate passive matching circuits 42, each of which is connected by at least one exciter probe 44 to the antenna notch 28.3. Excitation of the antenna may be connection of a pair of probes, one to each conductive side of the notch.

Figure 8:
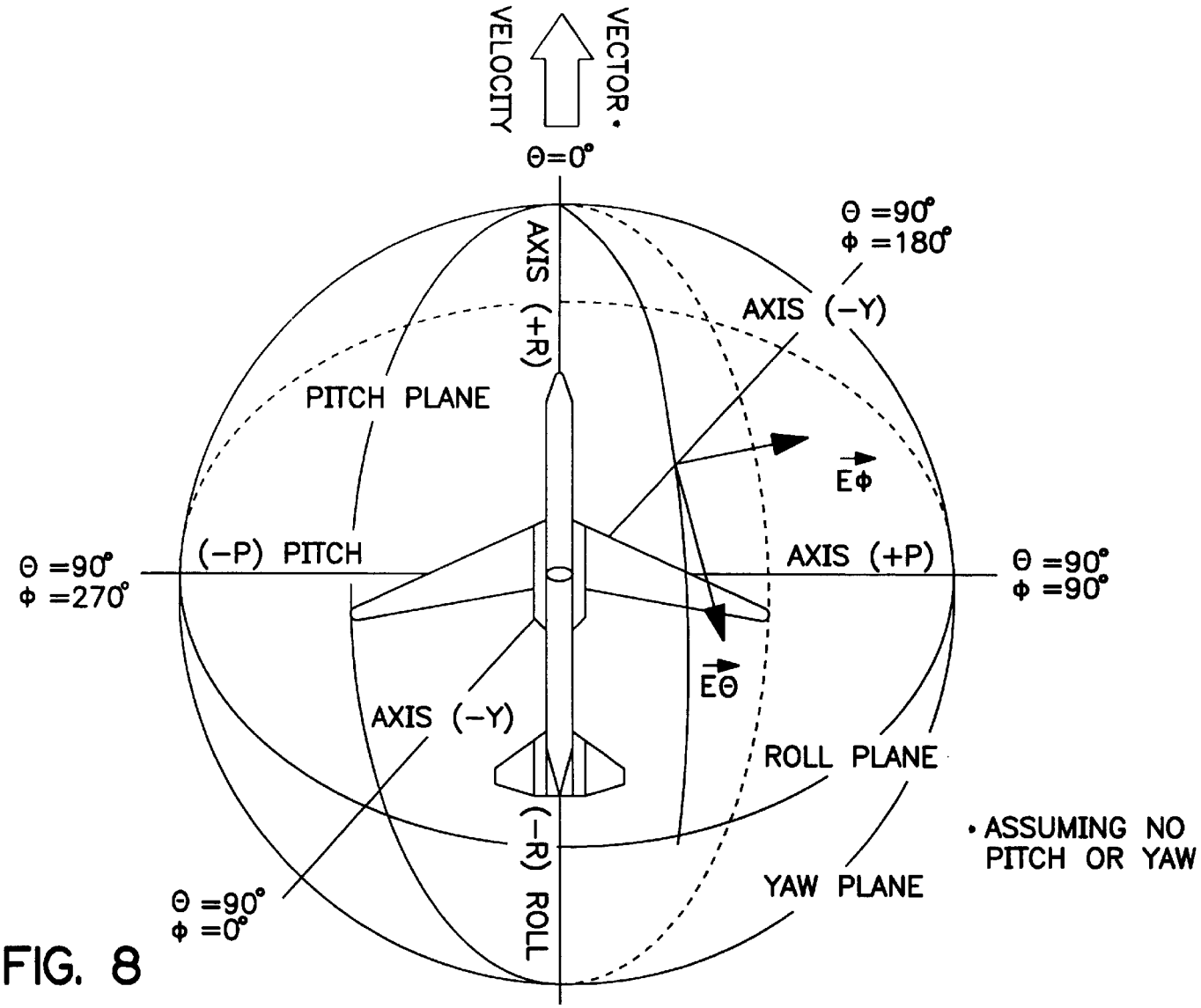
FIG. 8 is diagram of an aircraft coordinate sphere.

As shown in FIG. 8, the usual frame for reference for an aircraft employs a roll axis, indicated by (−R)(+R), extending longitudinally through the aircraft fuselage, a pitch axis, indicated by (−P)(+P), extending across the wings, and a normally vertical yaw axis (−Y)(+Y) mutually perpendicular the roll and pitch axes. The yaw plane is a plane perpendicular to the yaw axis, i.e., a generally horizontal plane through the aircraft. The pitch plane is a plane perpendicular to the pitch axis, i.e., a generally vertical plane through the aircraft and extending from front to rear. Finally, the roll plane is a plane perpendicular to the roll axis, i.e., a generally vertical plane through the aircraft and extending from side to side.

Figure 9:
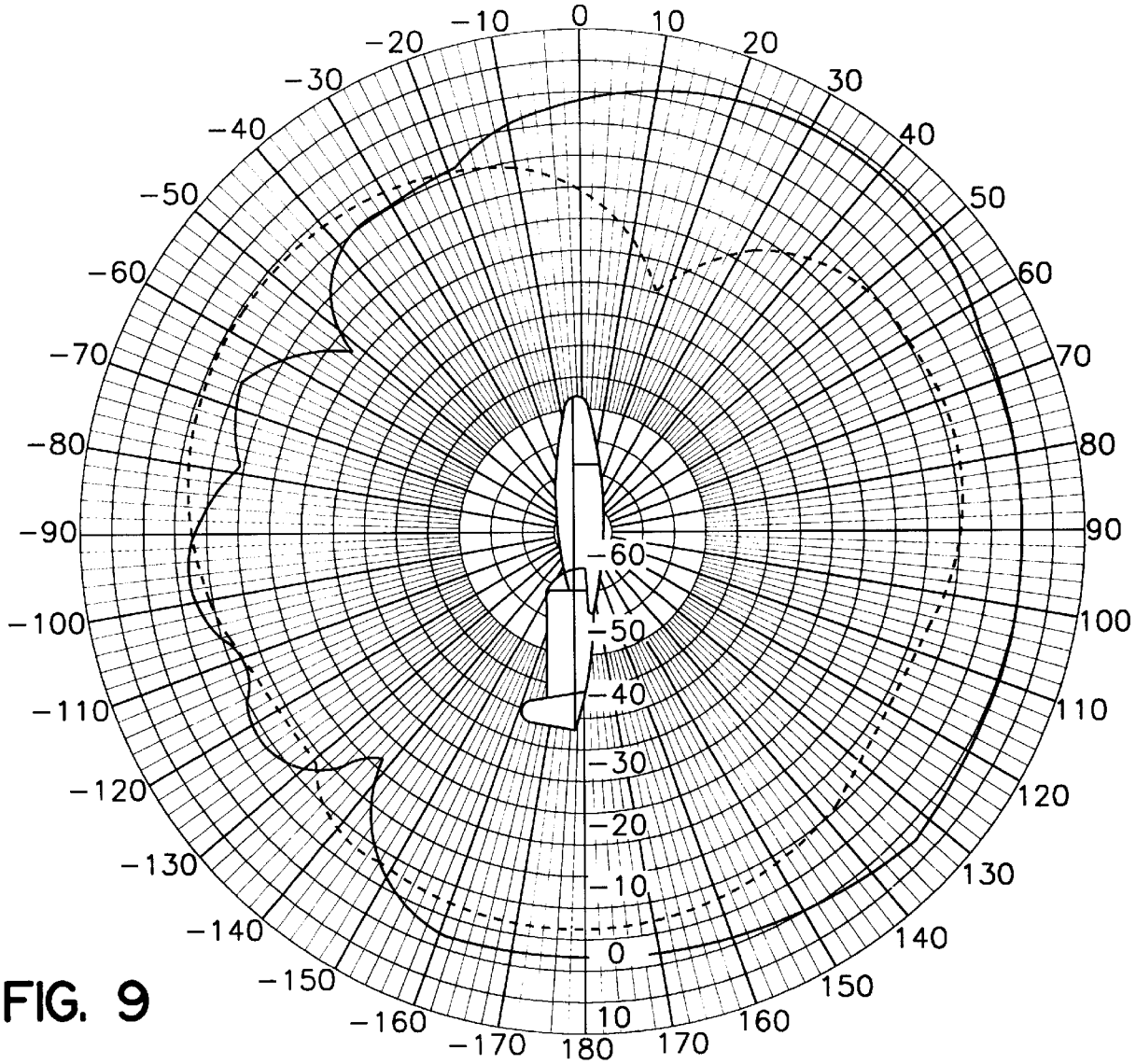
FIG. 9 is a measured pitch cut antenna pattern comparable to the simulated pattern of FIG. 3, for signals at 40 MHz.
Figure 10:
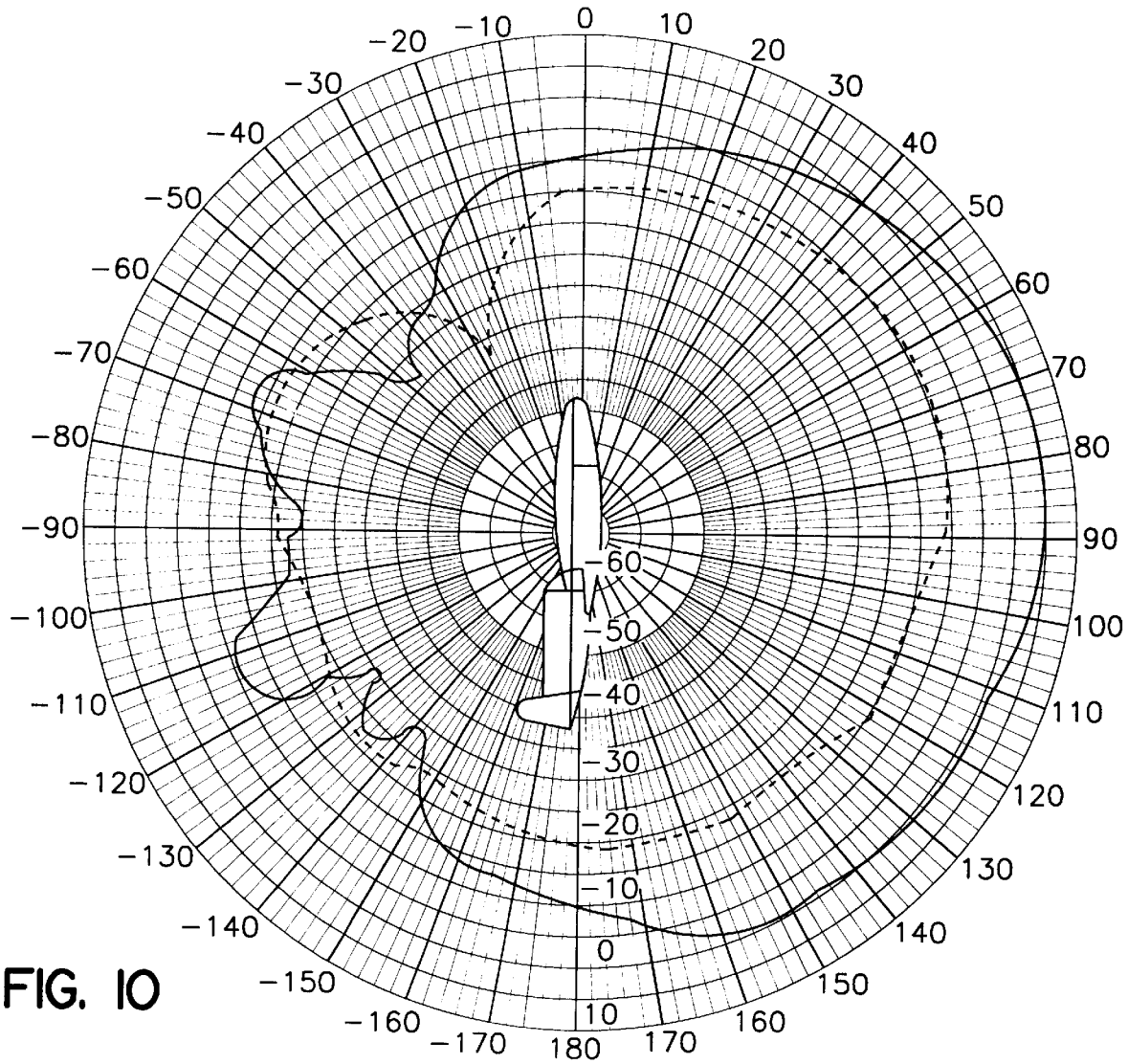
FIG. 10 is a measured pitch cut antenna pattern comparable to the simulated pattern of FIG. 4, for signals at 60 MHz.
Figure 11:
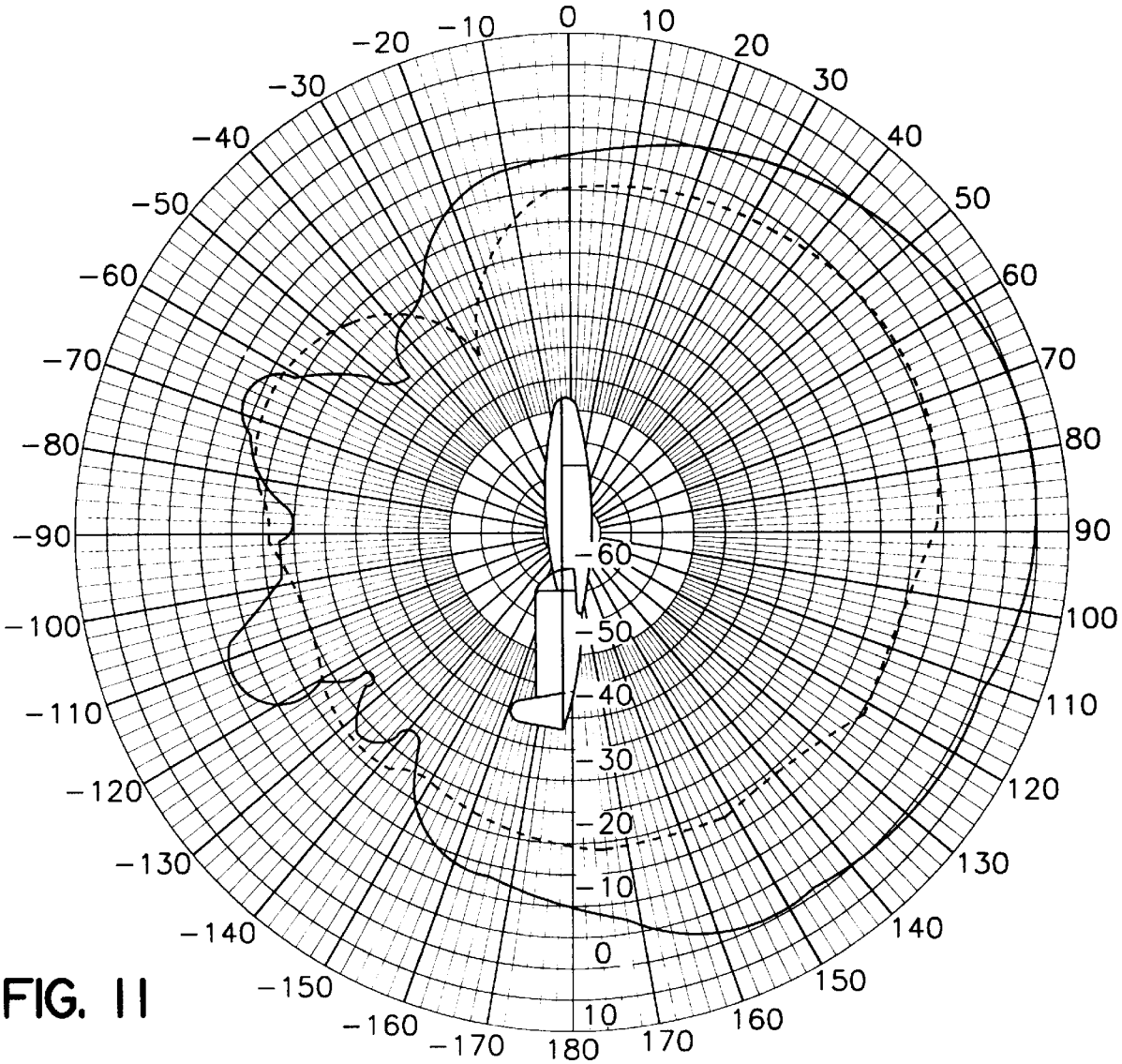
FIG. 11 is a measured pitch cut antenna pattern comparable to the simulated pattern of FIG. 4, for signals at 80 MHz.

The angles θ and ϕ represent the azimuth direction in the yaw plane and the elevation angle in the roll plane. Vertical and horizontal polarization is referenced to this coordinate system. Thus, when vertical polarization is denoted the E-field vector, Eθ, is parallel to the yaw axis, and when horizontal polarization is denoted the E-field vector, Eϕ, is parallel to the pitch axis. FIGS. 9–11 show the measured antenna patterns at 40 MHz, 60 MHz and 80 MHz, respectively. These are pitch cut gain patterns, with the nose and tail of the aircraft located at 0° and 180°, respectively. Each of the figures shows the gain variation for vertical polarization (solid line) and for horizontal polarization (dashed line). The gain measured was on the order of a hundred times greater than could be obtained using conventional blade antennas.

In accordance with another aspect of the invention, multiple antennas in the external equipment pod 12 can be used to simplify reconfiguration of aircraft for different missions. Multiple pods can be designed and constructed for different missions, each with different antenna configuration requirements. The equipment housed in each pod may also be selected to meet mission-specific requirements. An aircraft can then be reconfigured for a new mission by simply removing one pod, installing another, and making appropriate connections to equipment within the aircraft.

It will be appreciated from the foregoing that the present invention represents a significant advance in the field of antennas for aircraft having an external equipment pod. The invention provides a plurality of highly efficient multifunction antennas with high gain in all directions and for both vertical and horizontal polarization. Moreover, the antenna system of the invention does not significantly affect aerodynamic drag or available payload the vehicle. Although an illustrative embodiment of the invention has been described in detail for purposes of illustration, it will also be appreciated that various modifications may be made without departing from the spirit and scope of the invention. Accordingly, the invention should not be limited except as by the appended claims.

What is claimed is:

1. An aircraft antenna system structurally integrated into an external equipment pod carried by an aircraft, the antenna system comprising:

an externally mounted aircraft equipment pod, at least one wall of which includes an antenna notch formed from non-conductive material and positioned between two adjacent conductive regions of the pod wall, wherein the notch and the two adjacent conductive regions are structurally integrated to perform mechanical functions of the equipment pod wall and wherein the notch extends from a narrow region to a flared wider region; and an antenna feed terminating at a feed point located in the narrow region of the notch, to couple transmitted energy into the notch and to couple received energy out of the notch;

wherein the pod is mechanically connected to the aircraft by an electrically conductive connection;

and wherein the adjacent conductive regions of the pod and other conductive regions of the entire aircraft structure function as a radiating and receiving component of the antenna system, which provides an omnidirectional radiation pattern supporting vertically and horizontally polarized communication functions.

2. An aircraft antenna system as defined in claim 1, wherein:

the external equipment pod includes at least two walls with antenna notches of non-conductive material; and each wall of the external equipment pod having an antenna notch also includes an antenna matching unit mounted adjacent to a narrow portion of the notch, to match the antenna impedance characteristics to transceiver equipment.

3. A method for configuring an aircraft for a specific mission, comprising the steps of:

providing a plurality of external aircraft equipment pods, each having a different antenna configuration integrated into selected walls of the pod, and each capable of carrying specialized equipment enclosed within the pod walls, comprising:

providing an equipment pod wall that includes a notch of non-conductive material located between two conductive regions of the pod wall; and integrating into the equipment pod wall an antenna matching unit, for matching antenna characteristics with those of a transmitter or receiver;

selecting an external equipment pod for a given mission, based in part on the antenna configuration needed for the mission;

loading the pod, if necessary, with specialized equipment needed for the mission; and mounting the pod on an aircraft using electrically conductive coupling devices;

wherein the antenna configuration of the mounted external equipment pod provides radiation patterns that are omnidirectional and exhibit high gain over a wide band of frequencies including VHF and UHF bands, and wherein conductive portions of the pod and of the entire aircraft act as antenna elements.

* * * * *